US005119731A

United States Patent [19]

Muller

[11] Patent Number: 5,119,731

[45] Date of Patent: Jun. 9, 1992

[54] STATION ON A RAILWAY OR OTHER LINE, SITUATED ON A VIADUCT

[75] Inventor: Jean M. Muller, Saint Quentin en Yvelines, France

[73] Assignee: Jean Muller International, Saint Quentin en Yvelines, France

[21] Appl. No.: 604,637

[22] Filed: Oct. 24, 1990

[30] Foreign Application Priority Data

Oct. 24, 1989 [FR] France ..... 89 13911

[51] Int. Cl.[5] ..... B61B 1/00

[52] U.S. Cl. ..... 104/28; 104/124

[58] Field of Search ..... 104/27, 28, 29, 30, 104/31, 120, 123, 124, 125, 126

[56] References Cited

U.S. PATENT DOCUMENTS

| | | | |
|---|---|---|---|
| 578,626 | 3/1897 | Carver et al. | 104/28 |
| 1,645,026 | 10/1927 | Sachs | 104/30 |
| 3,515,074 | 6/1970 | Helbig | 104/28 |

FOREIGN PATENT DOCUMENTS

| | | | |
|---|---|---|---|
| 2468701 | 5/1981 | France . | |
| 218960 | 9/1989 | Japan | 104/28 |
| 748067 | 4/1956 | United Kingdom . | |

OTHER PUBLICATIONS

*RationalisierungsmaBnahmen fur Produktion und Montage von 5400 gleichen Fertigteilen*, Betonwerk+Fertigteil-Technik, vol. 15, n°12, Dec. 1979, pp. 723-725.

*Die Sanierung der Muotabrucke in Ibach*, Route et Trafic, vol. 65, n°5, May 1979, pp. 183-186.

*Primary Examiner*—Margaret A. Focarino
*Assistant Examiner*—Joseph D. Pape
*Attorney, Agent, or Firm*—Breiner & Breiner

[57] ABSTRACT

Station on a railway or similar line, situated on a viaduct consisting of a carrying structure which comprises a running deck (3) stiffened by longitudinal (4), vertical or oblique ribs placed beneath the deck, the carrying structure resting on supports such as piers (1), the station comprising at least one platform element (6) placed along the carrying structure at a level above that of the running deck. The platform element (6) is supported by at least one sustaining piece (10) which on the one hand is connected to the deck by rods or cables (14) which are transverse, horizontal or slightly inclined to the horizontal, and which resist traction, and on the other hand bears on an abutment (13) carried by the closest longitudinal rib.

4 Claims, 1 Drawing Sheet

STATION ON A RAILWAY OR OTHER LINE, SITUATED ON A VIADUCT

BACKGROUND OF THE INVENTION

The present invention relates to a station on a railway or other line, situated on a viaduct consisting of a carrying structure which comprises a running deck stiffened by longitudinal, vertical or oblique ribs placed beneath the deck, the carrying structure resting on supports such as piers, the station comprising at least one platform element placed along the carrying structure at a level above that of the running deck.

Improvement in the transport networks of large modern cities frequently entails the construction of metro or suburban lines in a so-called "aerial" arrangement, in other words constituting a viaduct carried by piers, so as to reduce the space taken up on the ground.

Such viaducts comprise a carrying structure, which structure comprises a running deck stiffened by longitudinal, vertical or oblique ribs placed beneath this deck. This carrying structure rests on supports such as piers which have just been mentioned.

In order to form the carrying structure, either a metal construction is used or a concrete construction formed from precast elements, or from elements formed on site. The running deck, in the case of a concrete construction, is stiffened by rods and/or prestressing cables, arranged longitudinally and/or transversely. The longitudinal ribs can consist of solid shells or of a series of beams arranged in vertical planes or in oblique planes, connecting the deck to a lower vertical girder. The two longitudinal ribs can be connected, at their lower part, by a horizontal rigid part so as to form a substantially closed box girder, or simply be connected by a certain number of transverse girders, thus forming a box girder open towards the bottom The construction of the stations for fractions of tracks constructed as a viaduct essentially comprises the placing of platforms, situated along the running deck, at least on one side, at a height above this deck which is sufficient to permit the easy transfer of passengers and/or goods. According to the conventional technique, these platforms are supported by piers which can be independent of the piers, or of the masonry supports, supporting the carrying structure, or can be connected to it. In all cases, these additional piers increase, at the location of the station, the space taken up on the ground in a way which limits the possibilities of siting such stations.

The object of the invention is to reduce these restrictions by providing a station which takes up a space on the ground which is substantially not greater than that of the track beyond the station, and which is, moreover, inexpensive to construct, in particular by precasting.

SUMMARY OF THE INVENTION

In order to obtain this result, the invention provides a station of the type indicated above which has as its distinguishing feature that the platform element is supported by a sustaining piece, preferably plane and vertical as a whole, which on the one hand is connected to the deck by rods or cables which are transverse, horizontal or slightly inclined to the horizontal, and which resist traction, and on the other hand bears against an abutment carried by the closest longitudinal rib.

The sustaining piece can, as it were, be considered as articulated on the edge of the running deck, and forms a lever, one end of which bears on the longitudinal rib whereas the other end supports the platform element.

It is immediately clear that the space taken up on the ground by a station is substantially the same as that of another part of the viaduct, or is only very slightly greater than it, in the case where it is judged necessary to increase the cross section of the piers or to reduce their spacing at the location of the station. The relatively reduced weight of the platform elements can be easily supported by the carrying structure, all the more so since the transverse rods or cables which connect the sustaining piece at the level of the edge of the deck can serve to stiffen the latter in the transverse direction. It is, moreover, possible to provide for these cables to extend from one edge of the deck to the other so as to create a structure which is substantially in equilibrium. The compressive force resulting from the weight of the sustaining piece and of the platform element is transferred to the lower part of the longitudinal rib, in other words not far from where it bears on the support or pier.

The sustaining piece can also carry a light frame supporting a roof.

BRIEF DESCRIPTION OF THE FIGURES

The invention will now be explained in more detail with the aid of a practical example, which is that of an "aerial" metro station, illustrated with the aid of the drawings, in which.

DESCRIPTION OF THE PREFERRED EMBODIMENT

Figures 1, 2:
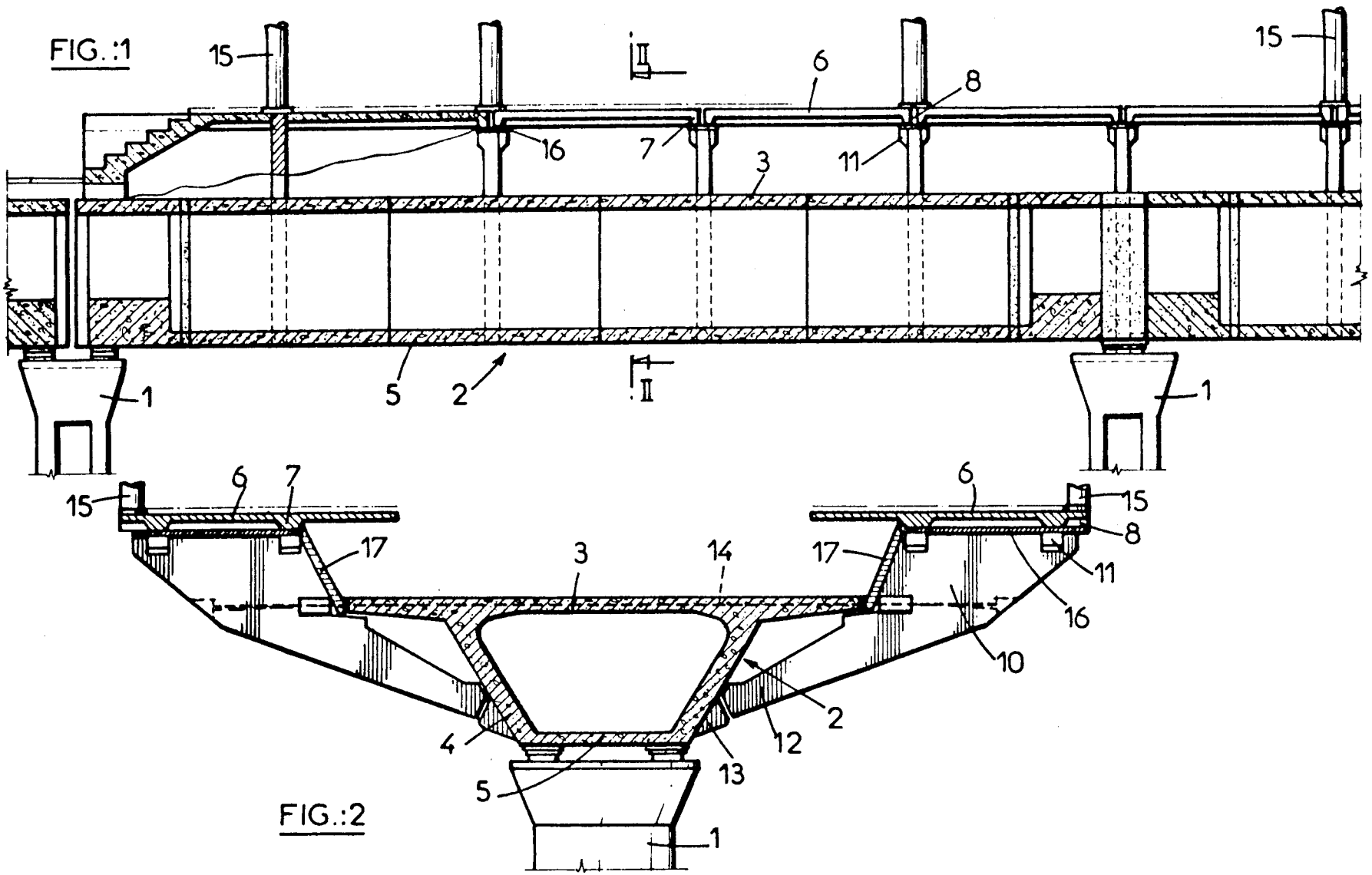
FIG. 1 is a vertical partial section of the metro section along the axial plane of the station with, on the left-hand side, a cutaway in the zone of a connecting flight of steps.
FIG. 2 is a cross section along the line II—II of FIG. 1.

The example described relates to a station consisting essentially of precast reinforced-concrete elements assembled on site but it is, however, clear that the invention applies equally to constructions of a different type.

Piers 1, whose spacing is, in the example chosen, 15 meters at the level of the station, support successive carrying-structure elements 2, consisting of a carrying deck 3, and of oblique 4 and horizontal 5 stiffening elements which form, together with the running deck, a carrying box girder with a trapezoidal cross section whose largest transverse width is approximately half the width of the running deck.

The carrying-structure elements, as well as the piers, are the same in an ordinary portion of the viaduct and in the station.

The platforms of the station are formed from a series of slabs 6 placed on either side of the carrying, structure and at a height of approximately 1.30 meters above the upper surface of the running deck. These slabs are rectangular plates whose dimension, in the example described, is 3 meters in the longitudinal direction of the station. This distance is, of course, arbitrary. It is, however, preferable for all the slabs to have an identical longitudinal dimension which is a sub-multiple of the length of the carrying-structure elements. If the station is on a curve, the slabs, or some of them, will have an adapted shape, for example a trapezoidal shape.

The slabs are reinforced, on their lower face, by longitudinal ribs 7 and by transverse ribs 8, the latter being situated along the edges of each plate. The platform is held by a series of sustaining pieces 10 which have a roughly triangular general shape with a horizontal upper side designed in order to support the transverse flanges 8 of the platform plates 6. Widened parts 11 protrude transversely relative to the plane of the piece 10 and support the end of the longitudinal ribs 7 of the plates 6 beyond their join with the transverse ribs 8. The opposite end 12 of the sustaining piece 10 is designed as a bearing element which rests on an abutment 13 provided on the carrying structure. In the example shown, the abutment 13 consists of a projection from the carrying-structure element 2, made of reinforced concrete. The carrying-structure elements intended to form part of a station consequently have a slight difference from the elements of an ordinary portion of viaduct. It is, however, possible to provide identical carrying-structure elements for the ordinary portion of the viaduct and for the station, the abutment then being fixed on the strengthening part 4 by any known means. This arrangement can be used, in particular, when it is desired to site a station in a place where it was not provided initially, or in order to lengthen a station.

Elements for joining the sustaining piece 10 to the outer edge of the running deck are provided at the level of the latter. Cables have been shown at 14 of the prestressing cable type, arranged horizontally in a transverse plane and which traverse the sustaining piece, pass inside the thickness of the running deck and traverse the sustaining piece situated on the opposite side. This joining method, which can be replaced by other joining methods, for example clamps fastened to rods of reinforcements of the running deck, is capable of essentially resisting traction, and can permit, if necessary, slight pivoting movements. It is therefore possible to consider the sustaining piece 10 as functioning like a lever which is articulated at the level of the edge of the running deck and one arm of which bears on the abutment 13, whereas the other lever arm carries the platform slabs.

Two opposite sustaining elements, connected by the cables 14, form a unit which introduces only very slight stresses on the running deck, especially when the cables 14 are horizontal and do not generate bending stresses on the deck.

In the example described, the cables are subjected to a pretensioning which presses the sustaining pieces 10 against the running deck and subjects the latter to transverse compressive prestress. Other arrangements are conceivable: for example, each cable 14 can bear on the edge of the deck which is on the opposite side, which creates a transverse prestress in the deck. The cables 14 can also be replaced by attachments connected to reinforcement rods of the deck, especially if the structure of the platform and of its sustaining elements is light.

The platform slabs 6 carry, on their outer edge, posts 15 intended to support, on the one hand, light roof elements and, on the other hand, railings etc. Sound- and vibration-absorbing layers 16 are inserted in between the slabs 6 and the sustaining elements 10 as is well known. Boarding and protection plates 17 are inserted between the platform plates 6 and the running deck 3 for the purpose of safety. These plates 17 bear on the edge of the sustaining pieces 10.

As can be seen, the system described by way of example permits substantial precasting and does not require any appreciable increase in the space taken up on the ground.

Numerous variants are possible. The system can be applied to carrying structures of diverse forms. It is, however, preferable, in the case where the carrying structure forms, together with its stiffening elements, a structure in the form of a box girder open towards the bottom, to provide transverse abutment elements intended to receive the pressure of the bearing pieces 12 which is transmitted by the abutments 13.

Even though the example describes a precast assembly, it is, of course, possible for all or part of the assembly to be moulded on site. It is also possible to provide for a more or less substantial portion of the elements, instead of being in reinforced concrete, to have a metal or other structure.

I claim:

1. Station on a transport line situated on a viaduct consisting of a carrying structure which comprises a running deck stiffened by longitudinal ribs extending downward beneath the deck, the carrying structure resting on supports, and the station comprising at least one platform element positioned along the carrying structure at a level above that of the running deck, said at least one platform element being supported by at least one sustaining piece which at a first end is connected to the deck by joining elements which are transverse, substantially horizontal and which resist traction, and at a second end bears on an abutment carried by one of said longitudinal ribs positioned adjacent to said abutment.

2. Station according to claim 1 wherein said at least one platform elements are in the form of horizontal slabs, and said sustaining pieces are in the form of vertical plates, in transverse planes, each of said sustaining pieces being common to two adjacent platform slabs.

3. Station according to claim 1 wherein the carrying structure is formed using precast elements.

4. Station according to claim 1 wherein said joining elements hold the sustaining pieces pressed against the running deck and comprise tensioned cables which exert a transverse compressive prestress on said running deck.

* * * * *